US012325968B2

(12) United States Patent
Obermeyer

(10) Patent No.: US 12,325,968 B2
(45) Date of Patent: Jun. 10, 2025

(54) WATER CONTROL GATE ABUTMENT AIR VENT

(71) Applicant: Henry K. Obermeyer, Wellington, CO (US)

(72) Inventor: Henry K. Obermeyer, Wellington, CO (US)

(73) Assignee: Henry Obermeyer, Wellington, CO (US)

( * ) Notice: Subject to any disclaimer, the term of this patent is extended or adjusted under 35 U.S.C. 154(b) by 73 days.

(21) Appl. No.: 17/921,954

(22) PCT Filed: Apr. 28, 2021

(86) PCT No.: PCT/US2021/029742
§ 371 (c)(1),
(2) Date: Oct. 27, 2022

(87) PCT Pub. No.: WO2021/222467
PCT Pub. Date: Nov. 4, 2021

(65) Prior Publication Data

US 2023/0175223 A1 Jun. 8, 2023

Related U.S. Application Data

(60) Provisional application No. 63/016,952, filed on Apr. 28, 2020.

(51) Int. Cl.
*E02B 7/44* (2006.01)
*E02B 8/04* (2006.01)

(52) U.S. Cl.
CPC . *E02B 8/04* (2013.01); *E02B 7/44* (2013.01)

(58) Field of Classification Search
CPC ..... E02B 8/04; E02B 7/44; E02B 7/52; E02B 8/06; E02B 1/003
See application file for complete search history.

(56) References Cited

U.S. PATENT DOCUMENTS 1,404,092 A * 1/1922 Chapman ..... E02B 8/04 405/108
4,772,157 A 9/1988 Obermeyer
5,061,118 A * 10/1991 Lemperiere ..... E02B 7/16 405/114
5,092,707 A 3/1992 Obermeyer
5,195,846 A * 3/1993 Lemperiere ..... E02B 7/16 405/114
6,196,764 B1 3/2001 Bayssiguier
2019/0390427 A1 12/2019 Del Rey et al.

FOREIGN PATENT DOCUMENTS

CN 107975015 A * 5/2018 ..... E02B 8/00

OTHER PUBLICATIONS

International Application No. PCT/US2021/029742; Search Report and Written Opinion of the International Searching Authority dated Jul. 27, 2021.
U.S. Appl. No. 63/016,952, filed Apr. 28, 2020.

* cited by examiner

*Primary Examiner* — Benjamin F Fiorello
*Assistant Examiner* — Stacy N Lawson

(57) ABSTRACT

The present invention discloses improved means of venting bottom hinged water control gates through the abutments over a wide range of tailwater elevations while minimizing the hazard of trapping water born debris in the abutment vents. A single pipe, or a plurality of pipes, may be provided. Check valves may be provided to exclude water borne trash.

8 Claims, 8 Drawing Sheets

WATER CONTROL GATE ABUTMENT AIR VENT

This application is the US National Stage Application of PCT Application PCT/US2021/029742, filed Apr. 28, 2021, which claims priority to U.S. Provisional Application No. 63/016,952 filed Apr. 28, 2020. Each of said applications are incorporated herein by reference.

FIELD OF THE INVENTION

The present invention relates to the ventilation of bottom hinged water control gates. The pressure under the nappe that overtops a bottom hinged water control gate has a significant influence on the discharge coefficient. Whereas a gate with the air under the nappe supplied with air at 1 atmosphere will have a particular discharge coefficient, the same gate set at the same height and angular position may have a discharge coefficient 25% higher in the case of no air under the nappe. In the second case the nappe is deflected toward the gate by atmospheric pressure. With atmospheric pressure on both sides of the nappe, the nappe takes a predictable trajectory and the gate discharges at a repeatable flow rate for any given gate position and head water level and tailwater level. Tailwater level only has an effect if it is high. Bottom hinged gates are often fitted with air supply vents. Each such air supply vent only functions fully if it is in communication with the air under the nappe. Such vents cannot supply air when the gate is lower than the vent. Such a vent cannot supply air at atmospheric pressure when the tailwater is higher than the vent. If large vents are used, they may trap debris which can impede gate motion or damage abutment seals when the gate position is subsequently adjusted. The present invention overcomes the aforementioned shortcomings of the prior art.

DETAILED DESCRIPTION OF THE PREFERRED EMBODIMENTS

Figure 1A:
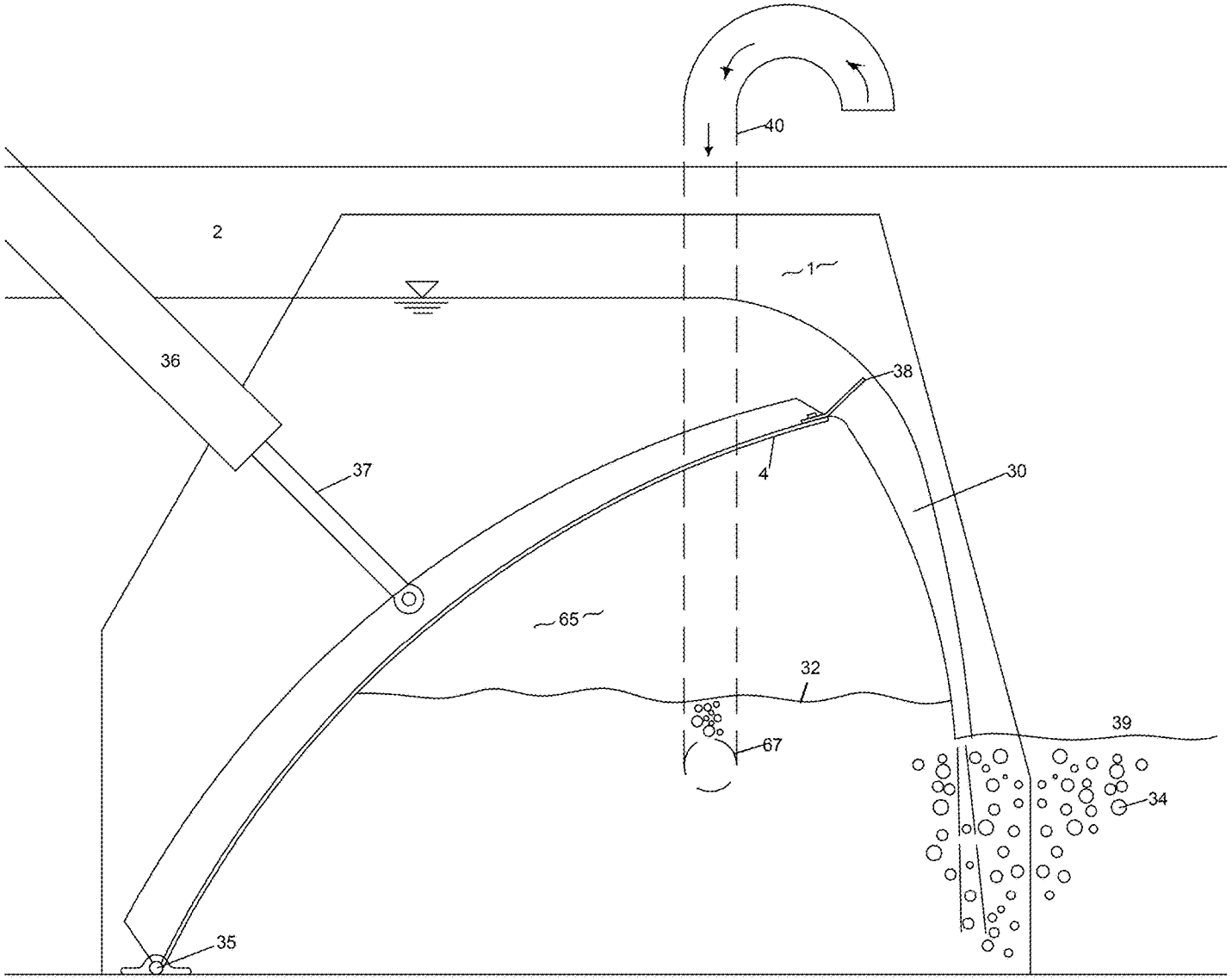
FIG 1A PRIOR ART
FIGS. 1*a*, 1*b* and 1*c* are sectional elevations of a water control gate and associated abutment air vent in accordance with the prior art.
Figure 1B:
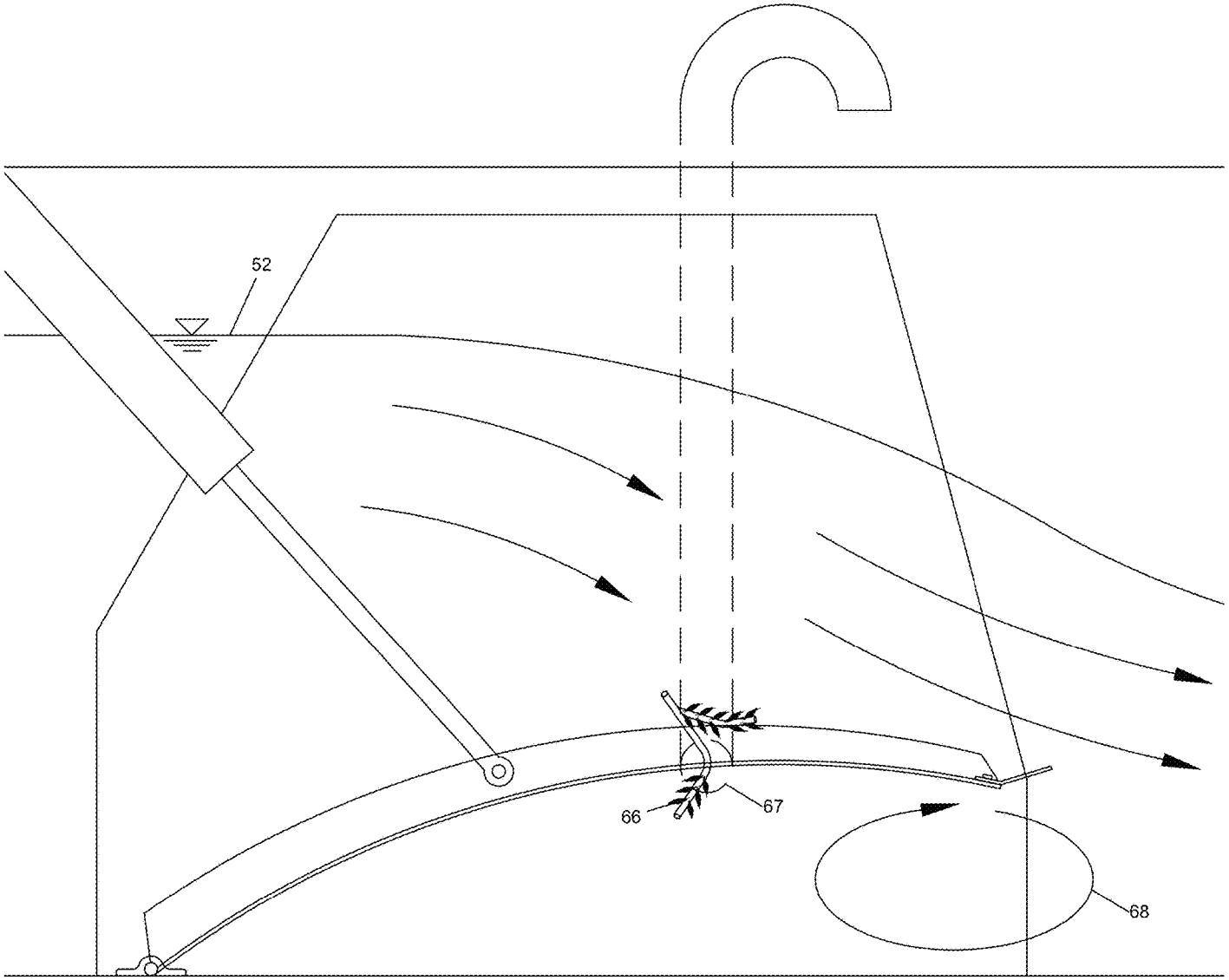
FIG 1B PRIOR ART
Figure 1C:
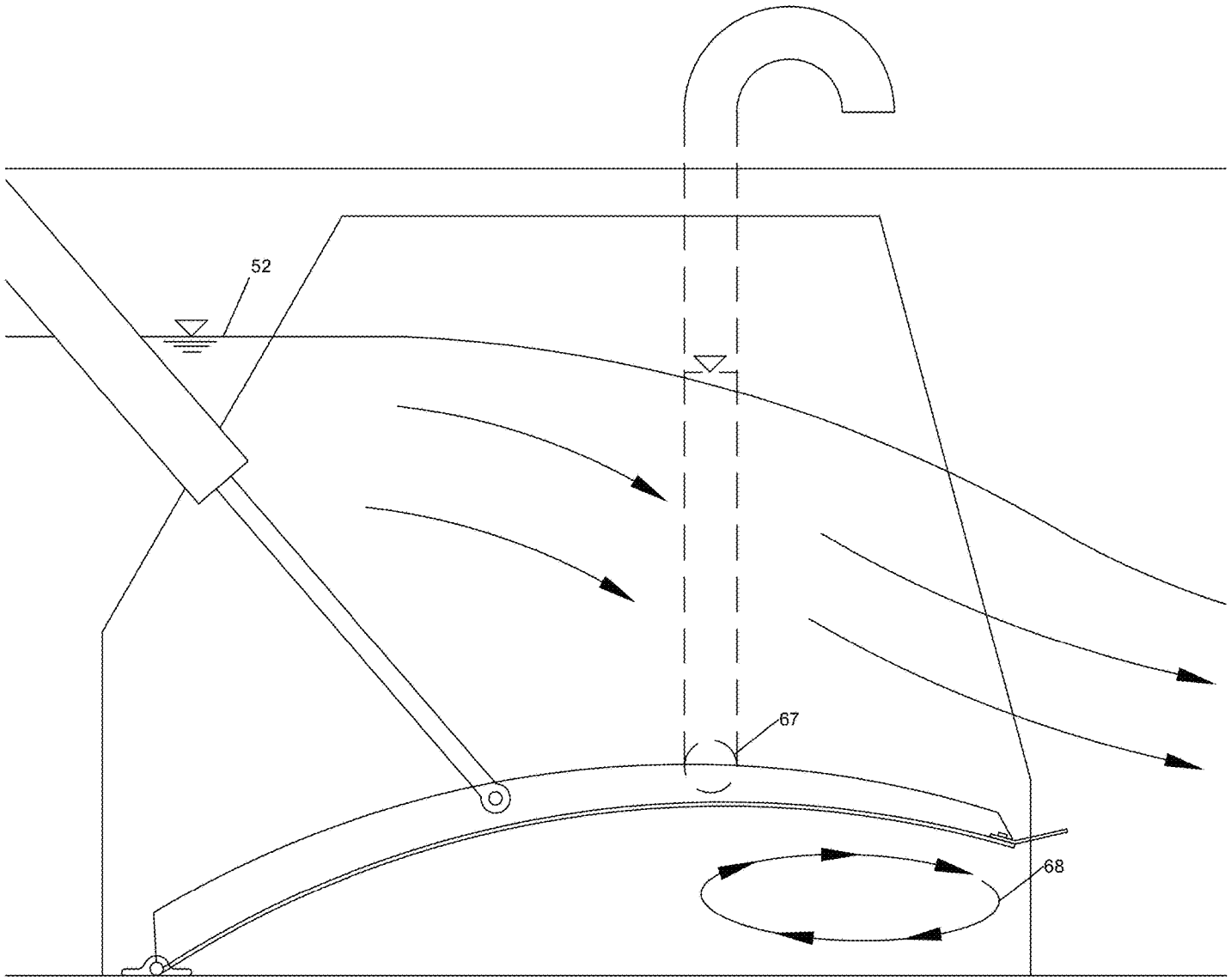
FIG 1C PRIOR ART

Referring to FIGS. 1A, 1B and 1C a prior art water control gate abutment air vent is illustrated in sectional elevation. Gate panel 4 is connected to the spillway with hinge 35 and is actuated with hydraulic cylinder 36 and rod 37. Abutment plate 1 provides a smooth sealing surface 70 on abutment 2. Air pipe 40 supplies ventilation air. In FIG. 1A, the tailwater (under the nappe) 32 is above abutment plate vent 67. The pressure of the air (behind nappe) 65 is thus below, rather than at, atmospheric pressure. This unnecessarily increases gate operating forces. Nappe breaker 38 is generally able to provide pressure balance between atmosphere and the air (upstream of the nappe) 65 if the nappe 30 is shallow enough for the nappe breaker 38 to protrude through it. Under low flow conditions, when the nappe breaker protrudes through the nappe, an abutment vent is not required. The purpose of the present invention is to provide nappe ventilation at flow rates beyond those for which the nappe breaker 38 can provide nappe ventilation. The tailwater (downstream of the nappe) 39 is lower than the tailwater (under the nappe) 32. Unreplenished air (upstream of the nappe) 65 is carried away in bubbles 34. FIG. 1B shows the edge of the gate panel straddling the abutment vent. This illustrates a shortcoming of the prior art wherein water born debris 66 may wash into the vent 67 from above the gate panel 4. This circumstance can cause damage to the abutment seals and can result in excessive gate operating forces. FIG. 1C illustrates the gate panel 4 below the vent 67. In this case no ventilation air may be provided under the gate, increasing gate operating forces and potentially leading to cavitation. Recirculating flow under the gate 68 is shown for reference in FIGS. 1B and 1C.

Figure 2:
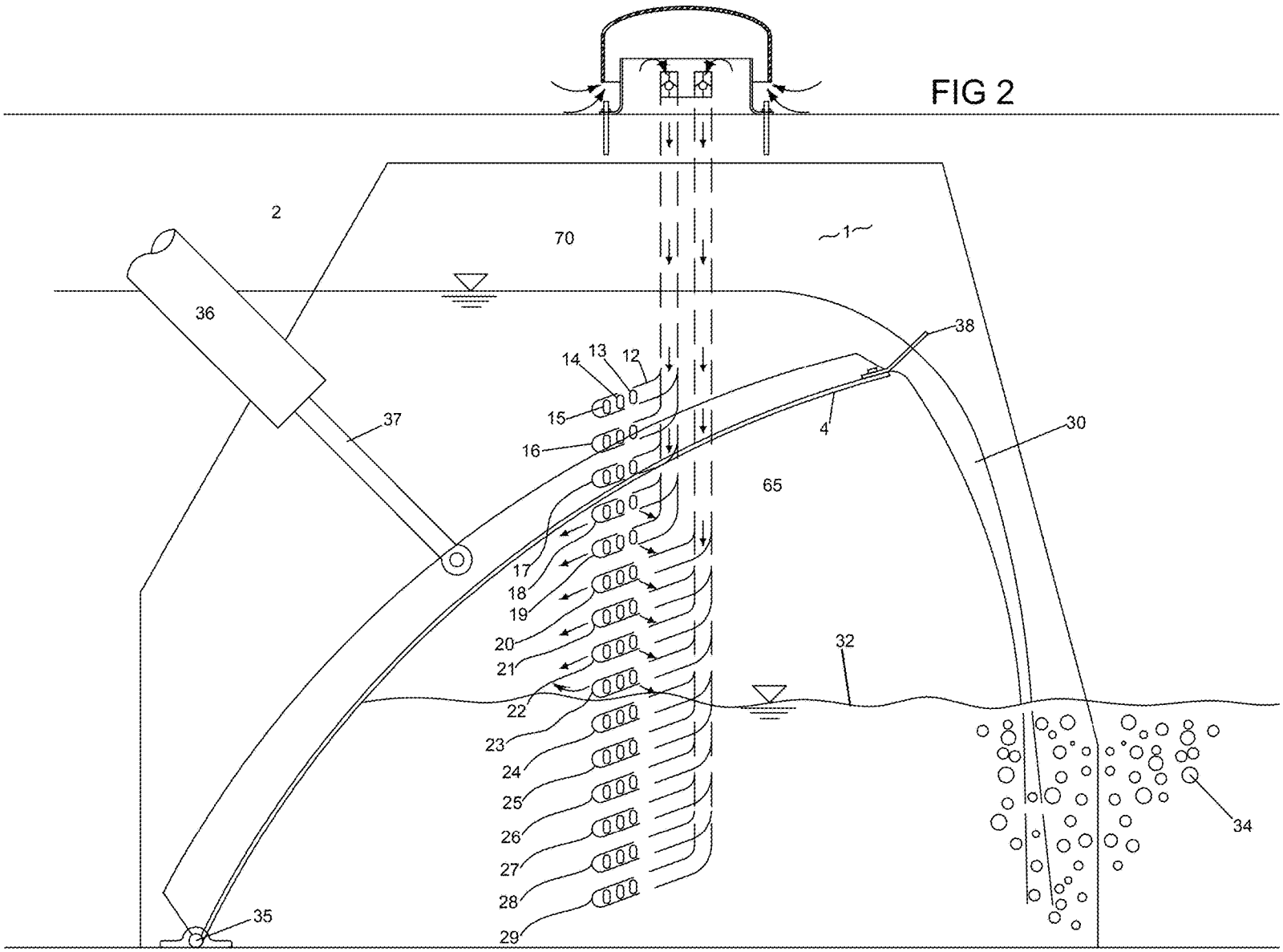
FIG. 2 is a sectional elevation of a water control gate and associated abutment air vent in accordance with one embodiment of the present invention.
Figure 3:
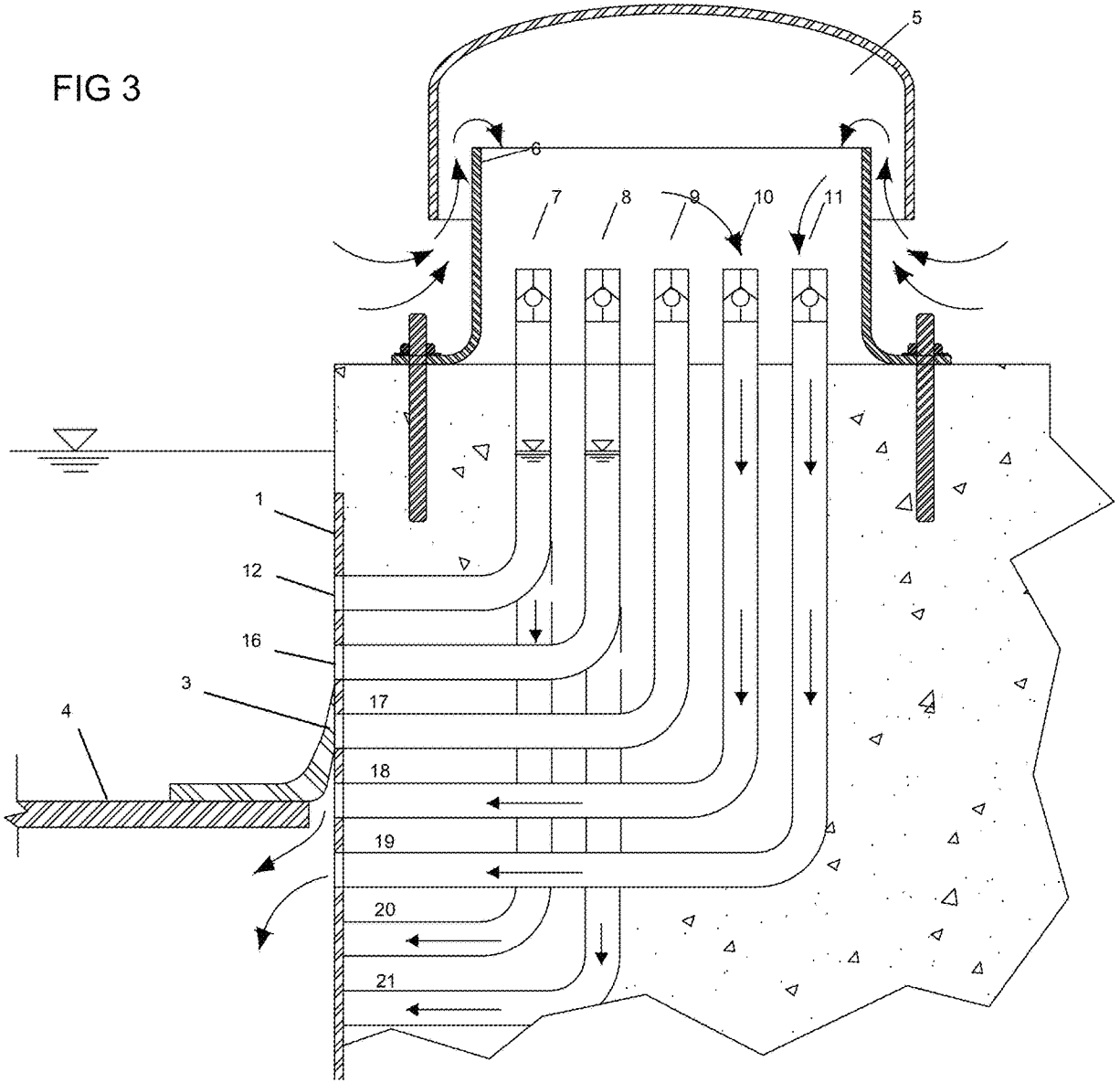
FIGS. 3 and 4 are transverse (normal to flow) sectional elevations of an abutment vent arrangement in accordance with the same embodiment of the present invention as FIG. 2.
Figure 4:
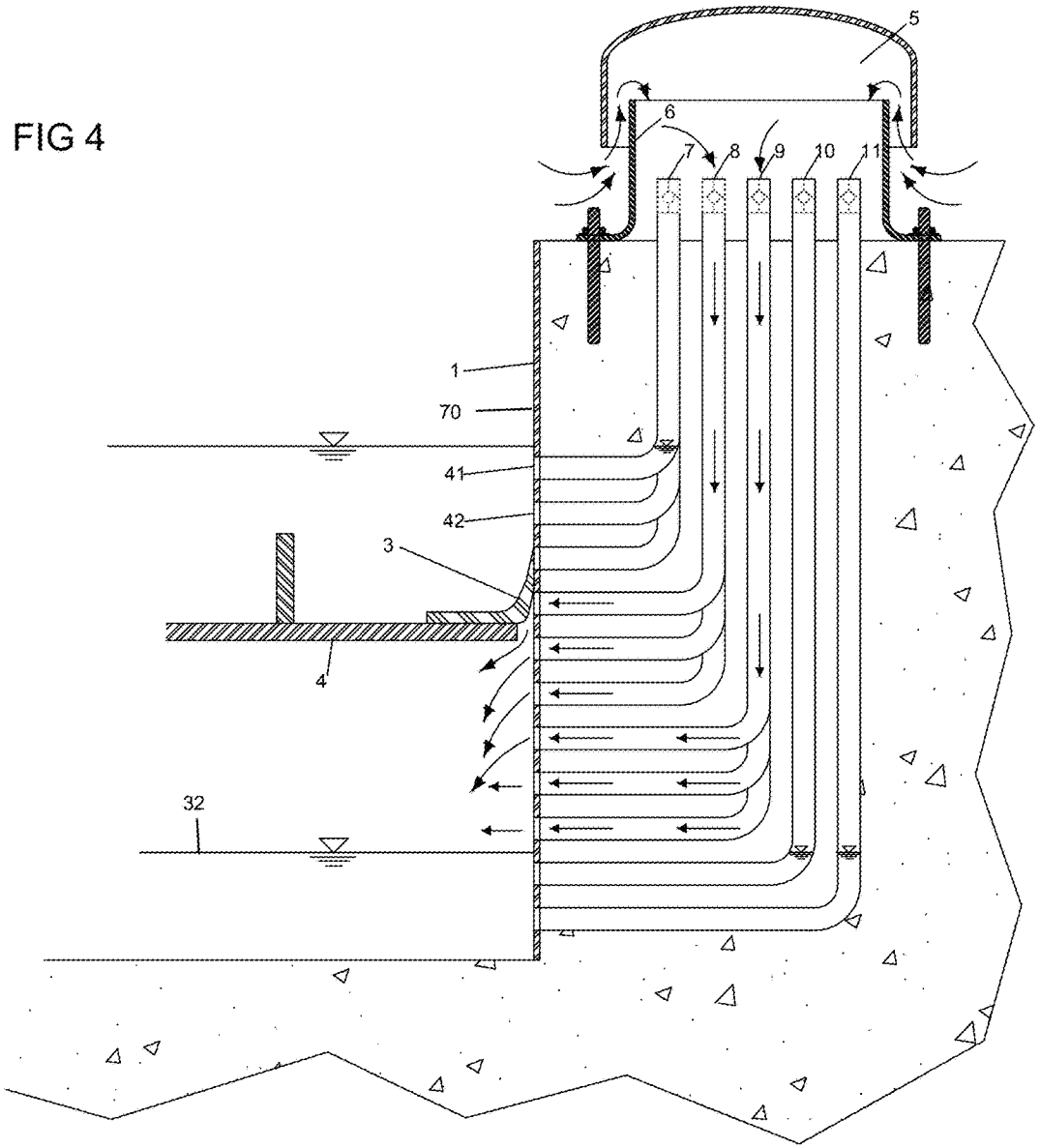

Referring to FIGS. 2, 3, and 4, one embodiment of the present invention is illustrated. Gate panel 4 is actuated by hydraulic cylinder 36 and rod 37. The gate panel is connected to the spillway by hinge 35. Air vents 12 through 29 provide ventilation air under the nappe depending on the position of gate panel 4 and the elevation of tailwater (under the nappe) 32. Under the conditions in the illustrated example, vents 12, 13, 14, 15, and 16 are in the headwater pool. These do not pass air because the headwater pool pressure exceeds atmospheric pressure. Vent 17 is obstructed by the abutment seal 3. Vents 18 through 23 provide ventilation air. Vents 24 through 29 pass no air because they are submerged in the tailwater (under the nappe) 32 which is above atmospheric pressure. Check valves 7 through 11 may optionally be used at the top of the abutment to limit flow so that it is only in one direction. Air duct 6 and protective cap 5 protect the vent lines at the top of the abutment wall. Unreplenished air upstream of the nappe 65 is carried away in bubbles 34.

Figure 5:
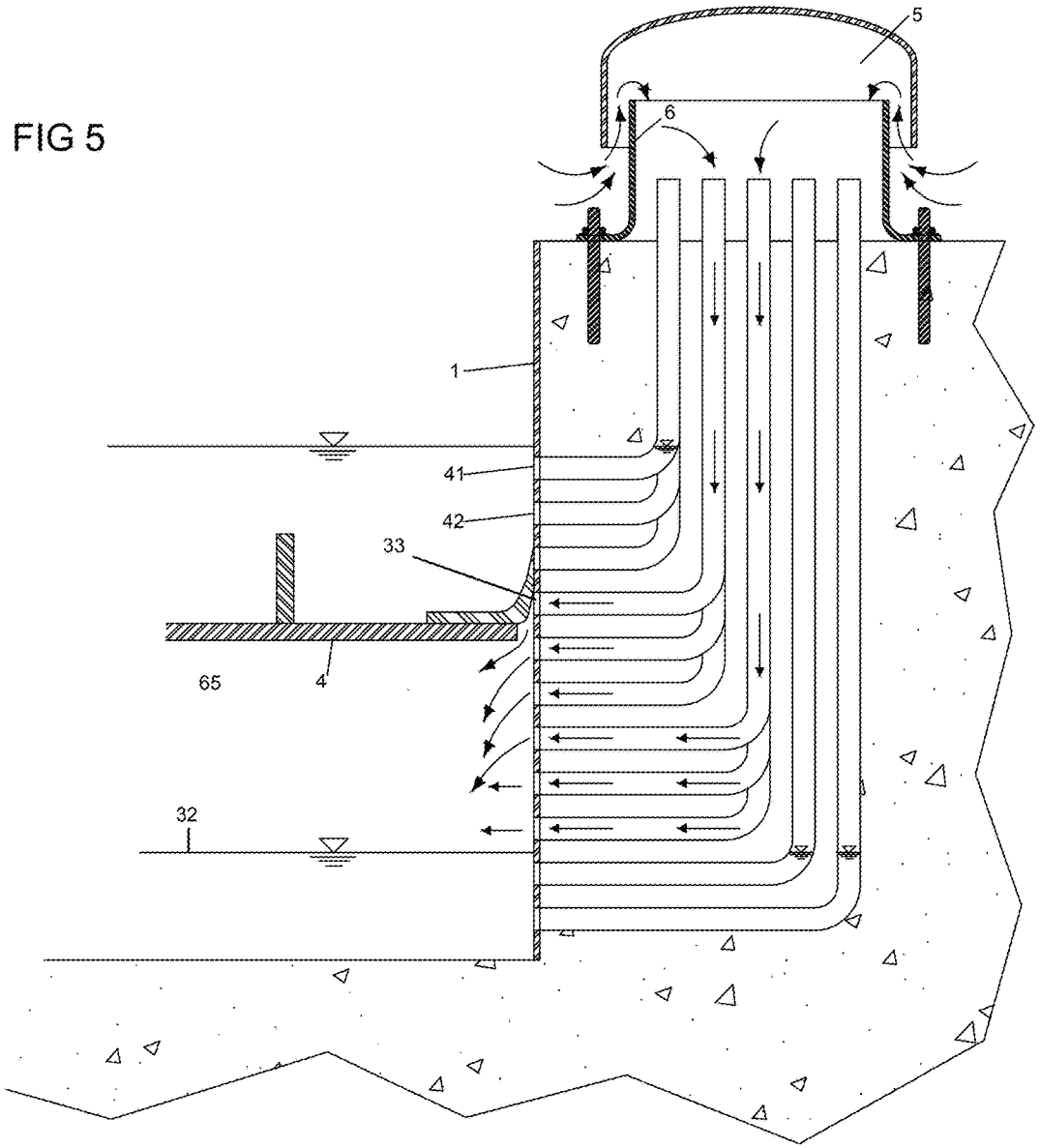
FIG. 5 is a transverse (normal to flow) sectional elevation of a water control gate abutment vent arrangement in accordance with a further embodiment of the present invention.

Referring to FIG. 5, another embodiment of the present invention is illustrated that requires no check valves. Vents 41 and 42 are in this instance submerged in headwater and pass no air. Vent 33 and the vents below it (except those submerged in tailwater) provide ventilation air. The lowest two vents are obstructed by tailwater and pass no air. This example illustrates the utility of having abutment vents at multiple elevations.

Figures 6A, 6B, 6C:
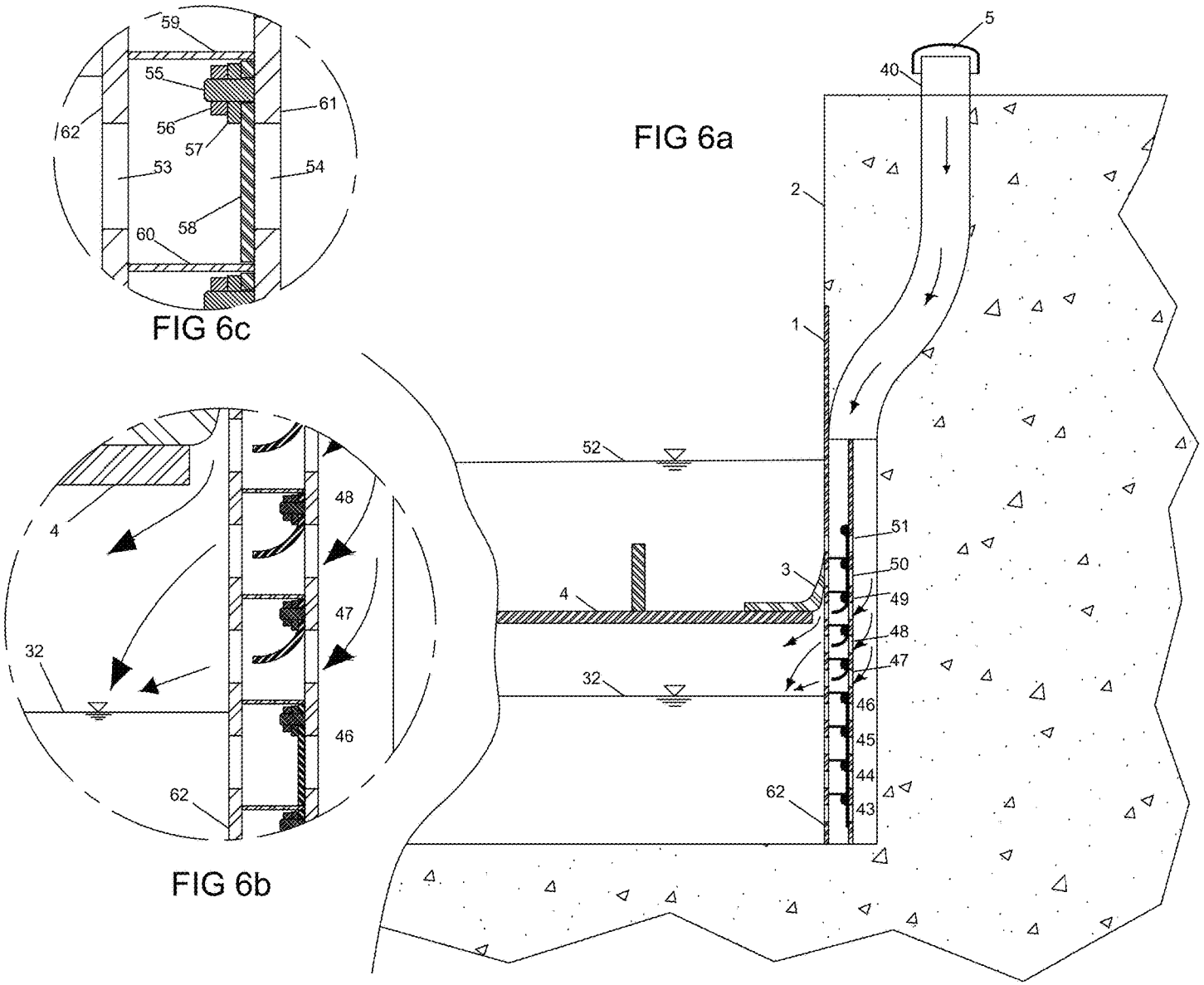
FIGS. 6*a*, 6*b*, and 6*c* are transverse sectional elevations of the water control gate in accordance with a further embodiment of the invention.

Referring to FIGS. 6*a*, 6*b*, and 6*c*, A preferred configuration of the present invention is illustrated. In this case any of the abutment plate vents can draw from a common air supply pipe 40. Check valves 43 through 51 prevent head water 52 from carrying debris into the vent system. Check valves 43 through 51 also prevent water from flowing into the vent system and blocking air flow. In the instance illustrated check valves 50 and 51 are closed by headwater pressure. Check valves 47, 48, and 49 replenish air upstream of the nappe 65 maintaining that pressure very close to atmospheric pressure. Check valves 43, 44, 45, and 46 remain closed due to the tailwater pressure being greater than atmospheric pressure.

The details of the check valves can be seen in FIG. 6*c*. Rubber flap 58 closes over opening 54 in stainless steel backing plate 61. Rubber flap 58 is secured by stud 55, nut 56, and clamp 57. Air supplied by the check valve passes through hole 53 in perforated abutment plate 62. Plate 62 is a perforated portion of abutment plate 1. Upper isolation plate 59 prevents flow from perforation 53 to the perforation directly above. Lower isolation plate 60 prevents flow from perforation 53 to the perforation directly below. It is preferable to mounted with flush screws so that it can be removed for servicing or cleaning the check valves. With this configuration trash is not washed into the assembly by water flowing through because the water is stopped by the check valves. The full capacity of vent pipe 40 is available to feed whatever check valves are open.

As can be easily understood from the foregoing, the basic concepts of the present invention may be embodied in a variety of ways. It involves both water control gates as well as inflatable conduit closures or other devices to accomplish the appropriate method. In this application, the inflatable actuation methods are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims which are included in this patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for the full patent application.

This patent application seeks examination of as broad a base of claims as deemed within the applicant's right and is designed to yield a patent covering numerous aspects of the invention both independently and as an overall system.

Further, each of the various elements of the invention and claims may also be achieved in a variety of manners. This disclosure should be understood to encompass each such variation, be it a variation of an embodiment of any apparatus embodiment, a method or process embodiment, or even merely a variation of any element of these.

Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "vent" should be understood to encompass disclosure of the act of "venting"—whether explicitly discussed or not—and, conversely, were there effectively disclosure of the act of "venting", such a disclosure should be understood to encompass disclosure of a "vent" and even a "means for tventing". Such changes and alternative terms are to be understood to be explicitly included in the description. Patents, publications, or other references mentioned in this application for patent are hereby incorporated by reference. In addition, as to each term used it should be understood that unless its utilization in this application is inconsistent with such interpretation, both traditional and common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Provisional Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to claim at least: i) each of the air vent devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the elements disclosed, xi) each potentially dependent claim or concept as a dependency on each and every one of the independent claims or concepts presented xii) individual or combined subroutines and programs as herein disclosed and described, xiii) the related methods disclosed and described, xiv) similar, equivalent, and even implicit variations of each of these systems and methods, xv) those alternative designs which accomplish each of the functions shown as are disclosed and described, xvi) those alternative designs and methods which accomplish each of the functions shown as are implicit to accomplish that which is disclosed and described, xvii) each feature, component, and step shown as separate and independent inventions, and xviii) the various combinations and permutations of each of the above.

It should also be understood that for practical reasons and so as to avoid adding potentially hundreds of claims, the applicant may eventually present claims with initial dependencies only. Support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. Further, if or when used, the use of the transitional phrase "comprising" is and will be used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Any acts of law, statutes, regulations, or rules mentioned in this application for patent; or patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s). Please be aware that cited works of non-patent literature such as scientific or technical documents or the like may be subject to copyright protection and/or any other protection of written works as appropriate based on applicable laws. Copyrighted texts may not be copied or used in other electronic or printed publications or re-distributed without the express permission of the copyright holder.

I claim:

1. An apparatus for delivering ventilation air at atmospheric pressure to a space that, when a nappe is overtopping a hinged, water control gate panel in raised position, is: below said hinged, water control gate panel; upstream of said nappe; and above a tailwater level that is below said nappe and said hinged, water control gate panel, said apparatus comprising:

an abutment sealing surface on a side of a dam abutment, said side of said dam abutment facing towards said hinged, water control gate panel;

an abutment seal attached to said hinged, water control gate panel and in contact with said abutment sealing surface, at least one vent inlet that is at said atmospheric pressure;

at least two vent outlets established through said abutment sealing surface; and vent piping passing through said dam abutment, from said at least one vent inlet to said at least two vent outlets, wherein said at least two vent outlets are at at least two different elevations so that, during flow of said nappe overtopping said hinged, water control gate panel in raised position, said vent piping delivers said ventilation air at said atmospheric pressure to said space through at least one of said at least two vent outlets, wherein each said at least two vent outlets has a respective vent outlet hole height and said abutment seal has a seal-to-abutment sealing surface contact height, and wherein said seal-to-abutment sealing surface contact height is greater than each of said respective vent outlet hole heights.

2. The apparatus of claim 1 further comprising at least one check valve established at each of said at least one vent inlet so as to prevent flow of said ventilation air out of each of said at least one vent inlet.

3. The apparatus of claim 1 further comprising at least one check valve established at each of said at least two vent outlets so as to prevent flow of water into each of said at least two vent outlets.

4. The apparatus of claim 1 wherein said at least two vent outlets comprise at least three vent outlets.

5. The apparatus of claim 1 wherein said vent piping comprises at least one pipe on an inlet side that is shared by at least two of said at least two vent outlets.

6. The apparatus of claim 1 wherein said abutment sealing surface comprises a surface of an abutment plate.

7. The apparatus of claim 1 wherein said apparatus is configured to deliver said ventilation air at atmospheric pressure from above said abutment.

8. The apparatus of claim 1 where said at least two vent outlets established through said abutment sealing surface at said at least two different elevations comprises at least three vent outlets established through said abutment sealing surface at at least three different elevations.

* * * * *